United States Patent [19]

Holzer

[11] Patent Number: 4,581,115

[45] Date of Patent: Apr. 8, 1986

[54] APPARATUS FOR THE PRECIPITATION OF COPPER FROM A LIQUID ELECTROLYTE CONDUCTED THROUGH A MULTI-CELL ELECTROLYTIC TANK

[76] Inventor: Walter Holzer, Drosteweg 19, Meersburg, Fed. Rep. of Germany, 7758

[21] Appl. No.: 668,656

[22] Filed: Nov. 6, 1984

[30] Foreign Application Priority Data

Nov. 8, 1983 [DE] Fed. Rep. of Germany ..... 3340360
Jun. 15, 1984 [DE] Fed. Rep. of Germany ..... 3422276

[51] Int. Cl.[4] ..... C25C 7/00
[52] U.S. Cl. ..... 204/275
[58] Field of Search ..... 204/275, 276

[56] References Cited

U.S. PATENT DOCUMENTS 3,558,455 1/1971 Sorensen ..... 204/273
4,051,001 9/1977 Inoue ..... 204/151
4,397,715 8/1983 Mohan ..... 204/24
4,468,305 8/1984 Hillis ..... 204/151

*Primary Examiner*—T. M. Tufariello
*Attorney, Agent, or Firm*—Lilling & Greenspan

[57] ABSTRACT

In electrolysis installations which possess in a common tank a plurality of anode and cathode plates electrically connected one behind the other, uniform supply to or flow through the individual cells is of greatest importance. According to the invention, the inflow, but also if possible the outflow, is placed below the liquid level, and a distributor pocket for uniform distribution of the liquid is connected between the inflow or outflow of the liquid and its entrance or exit from the electrolytic tank, respectively. For optimum adjustment of the chemical and physical constitution of the liquid, flow-independent measuring and adjusting of the liquid is achieved by a sensor which is arranged in a by-pass to the cycle line of the etching fluid between the etching tank and the electrolytic cell.

10 Claims, 6 Drawing Figures

APPARATUS FOR THE PRECIPITATION OF COPPER FROM A LIQUID ELECTROLYTE CONDUCTED THROUGH A MULTI-CELL ELECTROLYTIC TANK

FIELD OF THE INVENTION

The invention relates to an apparatus for the precipitation of e.g. copper from a liquid electrolyte by passage of the liquid stream metered through an inlet into the multi-cell electrolytic tank from which it exits through an outlet after precipitation of the copper.

BACKGROUND OF THE INVENTION

In the older processes and apparatus, the liquid electrolyte was conducted through the multi-cell electrolytic tank in such a way that uniform precipitation on the electrodes did not occur. This irregular precipitation results if the liquid distribution in the tank is not absolutely uniform.

In electrolysis installations possessing a plurality of anode and cathode plates connected electrically one behind the other in a common tank, uniform supply to and flow through, the individual cells is of greatest importance. Due to the uniform precipitation of e.g. copper from the liquid electrolyte on the electrodes, the precipitated copper can then immediately be used again in the etching process. Therefore, a recycling process is achieved, among other things.

In one of these known devices the sensor was located in the etching fluid, which is circulated continuously. Even if one places the sensor into stagnating areas of the etching tank, the measured result is still so imprecise that the purpose of the invention, namely to obtain an optimum etching rate, is not achieved. By immersion of circuit boards into the etching fluid, its physical and chemical composition changes. It has been found that to get an optimum etching rate, certain parameters of the chemical and/or physical constitution of the etching fluid must exist.

The present process relates to ecophile etching, i.e. the etching fluid is circulated continuously. It is not exchanged, as in known processes, when it is used up, but is regenerated or is given additions which ensure that an optimum etching rate exists.

SUMMARY OF THE INVENTION

The object of the invention is, therefore, to conduct the process and to design the apparatus so that an absolutely uniform distribution of the liquid electrolyte over the electrodes takes place, the liquid electrolyte to be optimally adjusted with respect to its chemical properties.

The solution of the problem of the invention now consists in that—proceeding from the known processes for the precipitation of e.g. copper from a liquid electrolyte by conduction of the liquid stream, metered through an inlet into the multi-cell electrolytic tank, whence it issues from an outlet after precipitation of the copper—the liquid stream passes through a liquid receiver formed by the liquid stream before the inlet located under the liquid level of the electrolytic tank, e.g. by the use of a liquid-buffer tank, in order to flow through the individual cells of the electrolytic tank with uniform distribution.

Here an entirely new route is taken. Heretofore the liquid electrolyte was indeed allowed to flow into the electrolytic tank metered and as uniformly as possible in a free jet, and via a drain or overflow the liquid stream, from which e.g. copper had now been removed, left the tank again. It turned out that on the electrodes a very uneven precipitation occurred, outright patterns formed, or where the flow was especially strong, no precipitation at all took place.

With the new process the liquid electrolyte no longer flows freely into the tank. It gets into the tank only via a liquid receiver. By this liquid receiver it is achieved—and tests have confirmed this—that a very uniform admission of the electrodes by the liquid electrolyte occurs. Since the velocity of the liquid stream from the inlet toward the outlet is very low, precisely at these low flow velocities it is important to carry out the admission of liquid stream very uniformly on the inlet side and analogously also on the outlet side to discharge the liquid stream again uniformly, in order that every square millimeter of the plates or boards—and there are usually a large number in such a tank—is evenly admitted by the liquid stream or respectively a very uniform precipitation then occurs.

The solution of the problem, namely to achieve an accurate, i.e. flow-independent measurement and adjustment of the etching fluid by a sensor, is effected in that the sensor is arranged in a by-pass to the cycle line of the etching fluid between etching tank and electrolytic cell, which is connected at adjustable intervals of time with the cycle line, e.g. via a valve, and the switching phase of the sensor takes place with the valve closed, i.e. in the by-pass during repose of the etching fluid.

Here an entirely new method is employed. Measuring is no longer done continuously, as is customary in such processes, but intermittently. The intervals of time result by taking from the liquid a sample, transferring it into a measuring vessel and then being able to measure this liquid accurately in the static state, independent of flow. As a function of this measured result the etching fluid is then regenerated or modified by additions until an optimum etching speed exists.

In a preferred embodiment, according to the invention consists in that the sensor is a float known in itself, with inductive or capacitive tap.

Further the sensor is appropriately contained in an overflow vessel disposed in the by-pass line.

This overflow vessel assures that the quantity of sample liquid remains always exactly constant.

Appropriately the valve is arranged in the airflow to the overflow vessel.

To ensure automatic operation, it is important that the valve is an electromagnetic valve whose open and closed position is program-controlled.

In a preferred embodiment, it is important that the valve is an electromagnetic valve whose open and closed position is program-controlled.

In a preferred embodiment, in which the copper content in the etching fluid is adjusted to a certain amount, it is important that the sensor switches the current supply of the electrolytic cell, e.g. via an amplifier.

The electrolytic cell is used for copper precipitation, and depending on an adjusted value, one is then in a position to assign to the etching fluid a certain specific gravity according to a specific copper content.

Another possibility is that the sensor regulates the liquid supply to the electrolytic cell, e.g. via a valve and an amplifier.

If not only the copper content is to be adjusted by a switchable electrolytic cell, but if other parameters are selected which are to be adjusted to achieve an optimum etching rate, there results a process for etching circuit boards by continuously monitoring the etching fluid in its tank; the teaching of the invention then consists in that the etching fluid is intermittently replenished by additions-depending on the number of etching operations—until an optimum etching rate is obtained. The process can be carried out exactly only by the fact that a sensor monitors the state of the etching fluid in a control vessel which is filled at selectable intervals of time, and that the measuring phase of the sensor is shifted to the static phase of the measured liquid in the control vessel.

A preferred device which solves the problem of obtaining a uniform distribution of the liquid electrolyte consists in that the liquid-buffer tank is formed by a partition, e.g. one arranged parallel to the inlet side of the electrolytic tank, whose upper edge lies below the liquid level of the electrolytic tank, while the lower edge and the lateral edges of this partition are connected water tight with the electrolytic tank in the manner of a dividing wall.

According to the new process, the construction costs will be very low if dividing walls are provided in the electrolytic tank on the inlet side and appropriately also on the outlet side.

This device is adaptable also according to whether the tank is to be charged with the liquid electrolyte from above or from below.

One possibility consists in that the inflow into the liquid-buffer tank occurs from below under hydrostatic pressure.

By using a buffer tank, therefore, it is here achieved that under hydraulic pressure, as it were, a uniform distribution takes place.

If the tank is to be charged from above, it is essential that the inflow into the liquid-buffer tank occurs via an additional preceding buffer tank, which is charged from above.

The design of the buffer tank or of the dividing walls may be different. One possibility is that the upper edge of the partition extends beyond the liquid level of the electrolytic tank and the inlet openings in the partition are arranged below the liquid level.

Depending on the size of the electrolytic tank and the type of liquid electrolyte, it is possible also that the inlet openings, arranged approximately at midheight of the liquid level, conduct the liquid stream evenly between the electrodes.

Also it is possible that instead of a plurality of inlet openings they are combined in one slit. A further possibility is that there are several partitions forming a siphon type receiver.

By using several dividing walls, the liquid stream will always be distributed evenly in a differentiated manner in an electrolytic tank of any size with any number of electrodes.

What is important is that the outlet side also has one or more partitions and the discharge below the liquid level through individual openings and/or slits occurs in a similar manner as at the inlet.

According to this embodiment, a variety of designs on the inlet side can be combined with the outlet side. For example, on the inlet side one might use two dividing walls and on the outlet side only one dividing wall, or one uses on the inlet and outlet sides the same distribution devices for the liquid stream. Depending on the requirements, the inlet openings in the partitions or dividing walls on the inlet side may be arranged at the top, but still below the liquid level, while on the outlet side they are located farther down. It is essential that the liquid goes in and out of the electrolytic tank, through openings, slits, overflow edges and the like, which are located below the liquid level.

An embodiment of the invention is represented in the drawings. Additional features of the invention will be evident from the drawings and the description therefor.

DETAILED DESCRIPTION OF THE INVENTION

Figure 1:
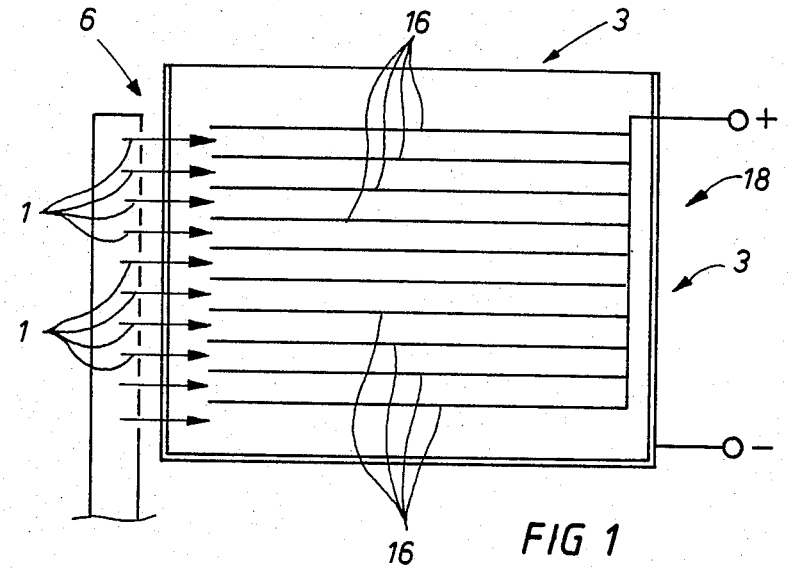
FIG. 1 is a schematic diagram of the flow pattern in an electrolytic tank.

In FIG. 1, the arrow direction 1 shows the liquid stream of the liquid electrolyte through the electrolytic tank 3. The liquid stream enters on the inlet side 6 and leaves the tank on the outlet side 18. Electrodes 16 are connected one behind the other as anodes and cathodes. In this connection the uniform supply to and flow through the individual cells is of greatest importance.

Figure 2:
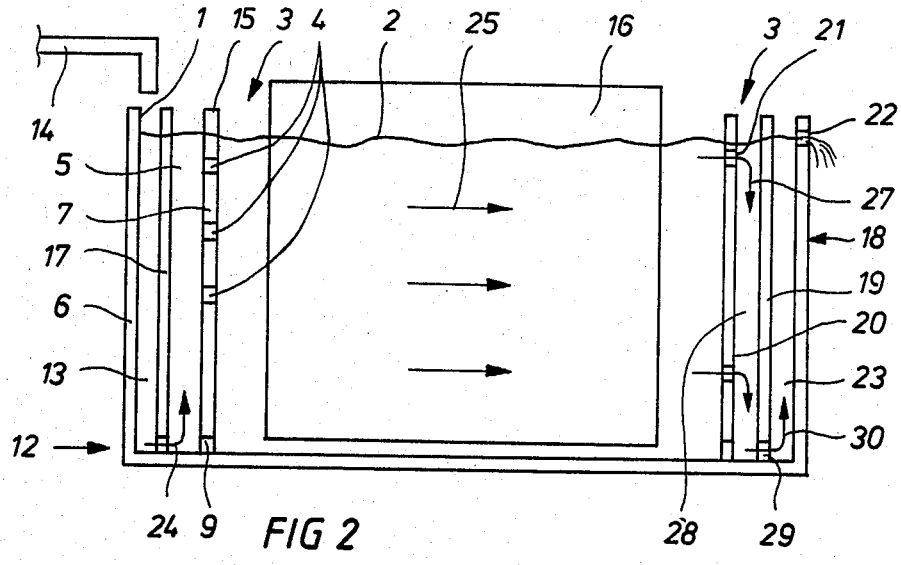
FIG. 2 is a side view illustrating the electrolytic tank with the partition.

According to the invention, in FIG. 2 as illustrated the liquid stream is charged in arrow direction 1 from above through a feed 14. In this case a preceding buffer tank 13 must be present, through which the liquid stream flows in arrow direction 24. It then enters the liquid-buffer tank 5, sweeping the additional partition 17, from below. The liquid-buffer tank is formed by a partition 7, whose lateral edges 10, 11, and the lower edge 9 are connected with tank 3 and made waterproof, so as to form a dividing wall. In this partition 7, inlet openings 4 are arranged. These inlet openings may be arranged either at the top, in the center, or distributed in any manner. If desired, tests will be made to determine how the most uniform admission of the individual plates is achieved during the precipitation. The only essential point is that the inlet openings are always located below the liquid level. Then the electrolyte is conducted in arrow direction 25 through the individual cells in such a way that the individual electrodes 16 experience a uniform distribution of the liquid stream. In FIG. 2 the upper edge 15 of partition 7 is above the liquid level 2, in order that the inlet openings or slits 4 will be below the liquid level 2. It is possible also that the upper edge 8 of partition 7 lies below the liquid level 2 and the partition then does not have inlet openings. The supplied liquid stream will then flow below the liquid level 2 in arrow direction 26 over this edge 8.

As indicated schematically in FIG. 2, instead of the upper inflow or, upper feed 14, a lower inflow 12 may be provided. In that case the preceding buffer tank 13 would be omitted.

Figure 4:
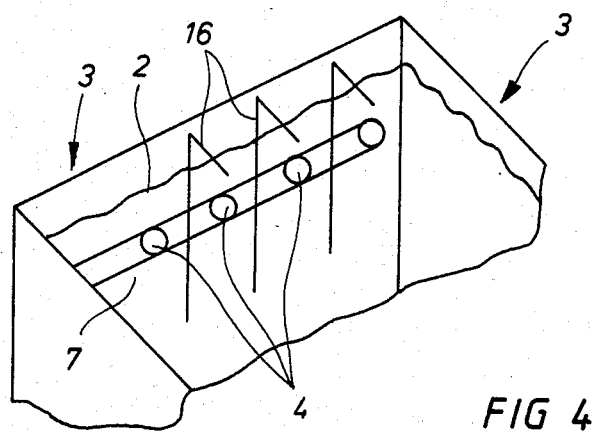
FIG. 4 is a partial perspective view of a third embodiment of the partition.
Figure 3:
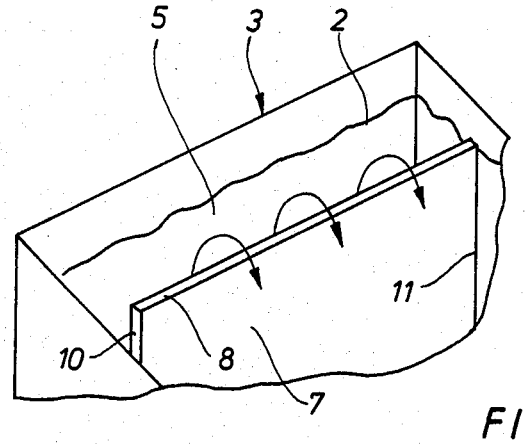
FIG. 3 is a partial perspective view of a second embodiment of the partition.

In FIG. 4 is it illustrated once more perspectively how inlet openings 4 under the liquid level 2 may be arranged in the upper region inside the partition 7.

In FIG. 2 is indicated schematically also that the outlet side 18 may be designed accordingly, it being possible to combine individual elements of the inlet side with other elements of the outlet side, but in themselves these elements are identical. In the embodiment, to achieve regulation of the liquid level 2, drains 21 are arranged in a partition 20. These drains may again be circular, slit type, or adapted to the flow in some other way. In the embodiment, the liquid flow arriving in arrow direction 25 then passes in arrow direction 27 into the buffer tank 28 on the outlet side, which may be designed analogously to the buffer tank 5 on the inlet side. An additional partition 19, which is arranged at the distance 29 from the bottom of tank 3, then permits the draining liquid to enter the after-connected tank 23 in arrow direction 30. There an overflow 22 is provided, that is to say, the now outflowing liquid gets to the outside in free fall. By this overflow it is automatically provided that the liquid level 2 remains constant. Although the embodiment described in the following is applicable also to an arrangement according to FIGS. 1 to 4, for better comprehension the organization of the measuring device is described in a modified embodiment.

Figure 5:
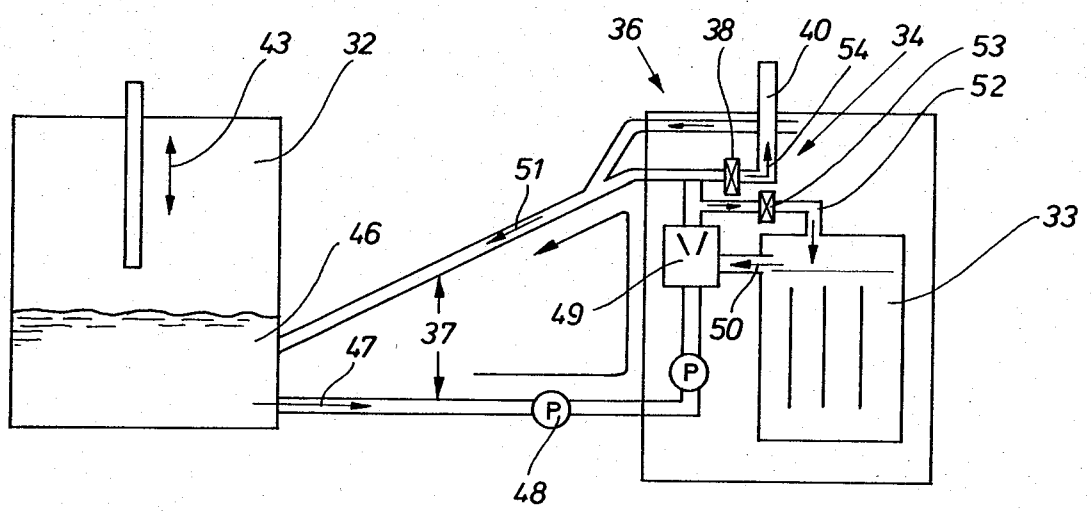
FIG. 5 is a side view illustrating an etching tank with an electrolytic cell and measuring device.

In FIG. 5, according to a further embodiment, circuit boards 31 are illustrated schematically, which are immersed in arrow direction 43 into the etching tank 32 in a manner known in itself for the production of electric circuits. The etching tank 32 is coupled with an electrolytic cell 33. A sensor 34, in the form of a float 35, is arranged in the by-pass 36 of a cycle line 37. A valve 38, which regulates the inflow to an overflow vessel 40, in which the float 35 is located, can be actuated by a program control 42. In the embodiment the float has an inductive tap 39 known in the art. The measuring arrangement switches on or off via its contact terminals 44 when the contact 39 attached to float 35, e.g. a reed contact, gets out of the magnetic field of the exciter coils 45 in the stationary part.

Figure 6:
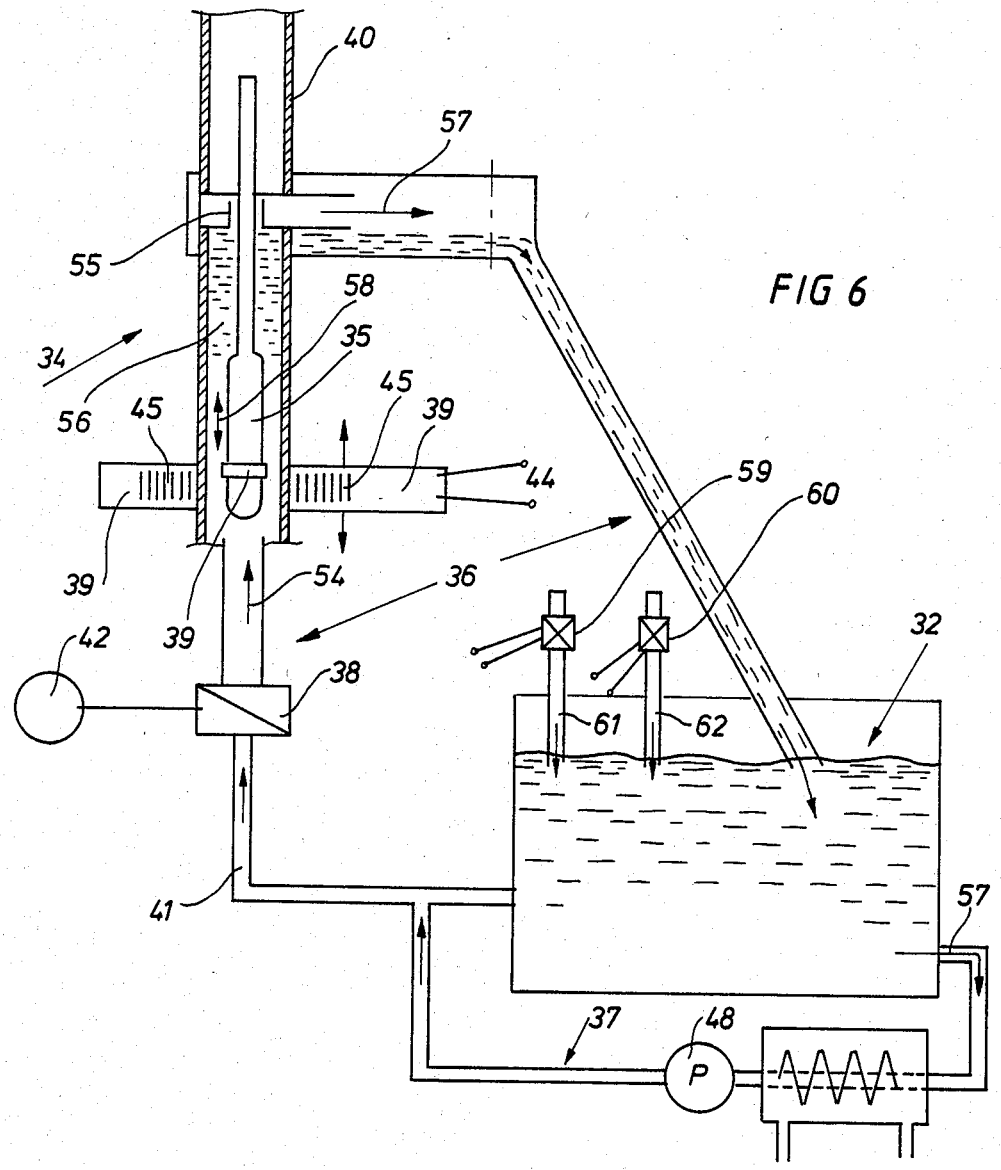
FIG. 6 is an enlarged side view illustrating the measuring device connected to an etching tank.

The etching fluid 46 is drawn by pump 48 in arrow direction 47 and thus gets into the cycle line 37. In the embodiment of FIG. 5 the cycle line contains further a water jet pump 49, which draws partial quantities of regenerated etching fluid out of the electrolytic cell 33 in arrow direction 50. The pump then conveys the partially regenerated etching fluid further in arrow direction 51 back into the etching tank 32. The feed to the electrolytic cell 33 occurs via a branch 52 when valve 53 is open. Valve 38 is opened at intervals of time, e.g. by a program control 42. Thereby a sample quantity is taken from the etching fluid present in the cycle line 47 and is passed in arrow direction 54 (cf. FIG. 6) into an overflow vessel 40. The overflow 55 in this vessel ensures that the quantity to be measured in the measuring tank 56 remains the same. If this measuring tank 56 is full, the excess sample quantity runs in arrow direction 57 back into the etching tank 32.

Depending on the measurement result, float 35 now moves in arrow direction 58, so that the contacts 54 e.g. turn off the current supply, not shown, of the electrolytic cell when the copper content in the etching fluid becomes too high, or turn it on again when it becomes too low.

Additional valves 59, 60 may be switched, which via lines 61, 62 feed additions into the etching tank 32. Depending on the type of etching fluid and/or the materials of the circuit boards, this additions bring the etching rate to an optimum.

I claim:

1. An apparatus to precipitate a metal element from a liquid electrolyte comprising:
   (a) an electrolytic tank having an inlet side with an inlet opening, and an outlet side with an outlet opening submerged in said liquid electrolyte;
   (b) at least one inlet partition positioned parallel to said inlet side of said electrolyte tank and having a lower edge and two lateral edges forming a waterproof wall with inside lateral walls of said electrolytic tank to define a liquid buffer container with said inlet side of said electrolytic tank, and a thruway of said partition submerged in said liquid electrolyte, said partition controlling a speed of said liquid electrolyte as it travels in a path from said inlet side to said outlet side of said tank;
   (c) at least one anode and one cathode; and
   (d) at least one outlet partition of a number equal to a number of said inlet partitions and positioned parallel to said outlet side of said electrolytic tank defining an outlet buffer container and controlling an outflow of said liquid electrolyte from said electrolytic tank, said outlet partition having an outlet thruway submerged in said liquid electrolyte.

2. An apparatus according to claim 1, wherein said inlet and outlet thruways of said inlet and outlet partitions are openings disposed in said inlet and outlet partitions facilitating the uniform flow of the liquid electrolyte through the electrolytic tank.

3. An apparatus according to claim 2, wherein said inlet thruways comprise a top edge of said inlet partitions.

4. An apparatus according to claim 2, wherein a second inlet partition is arranged parallel to said first inlet partition between said first inlet partition and said inlet side of said electrolytic tank to define a preconnected buffer container receiving a charged stream of said liquid electrolyte from an admission unit, and an entrance channel is formed between a bottom edge of said second partition and an inside bottom side of said electrolytic tank facilitating a movement of said charged stream from said preconnected buffer container to said liquid buffer container.

5. An apparatus according to claim 4, wherein a second outlet partition is arranged parallel to said first outlet partition between said first outlet partition and said outlet side of said electrolytic tank to define a buffer container between said first outlet partition and said second outlet partition, and an after-connected container between said second partition and said outlet side of said electrolytic tank, said second partition forming a channel between a bottom edge of said second partition and the bottom side of the electrolytic tank facilitating the uniform movement of the liquid electrolyte from said outlet buffer container to said after-connected buffer container.

6. An apparatus according to claim 1, wherein said outlet side of said electrolytic tank comprises an overflow drain insuring a constant level of said liquid electrolyte in said electrolytic tank.

7. An apparatus according to claim 1, wherein said apparatus further comprises means for detecting a specific level of the metal element in the liquid electrolyte.

8. An apparatus according to claim 7, wherein said means for detecting said specific level of said metal element comprises a cycle line connecting said electrolytic tank to an etching tank in a manner permitting the liquid electrolyte to flow between said tanks, a sensor positioned on said cycle line between said electrolytic and etching tank and measuring a specific amount of the liquid electrolyte, a valve positioned at a bypass on said cycle line and regulating an amount of the liquid electrolyte flowing through said cycle line to said sensor, and a pump conveying the liquid electrolyte through said cycle line.

9. An apparatus according to claim 8, wherein said sensor comprises a float located in an overflow vessel on said cycle line, said float having a set of inductive contact tabs encompassed in a pair of contact terminals positioned at a bottom end of said float.

10. An apparatus according to claim 8, wherein said valve is electromagnetic and is regulated between an open and closed position at regular time intervals by a controlled program as said float moves through a magnetic field of said contact terminals.

* * * * *